United States Patent [19]

Horenkamp

[11] Patent Number: 4,690,358

[45] Date of Patent: Sep. 1, 1987

[54] HEIGHT-ADJUSTABLE FITTING FOR FURNITURE

[75] Inventor: Franz Horenkamp, Bielefeld, Fed. Rep. of Germany

[73] Assignee: Ferdinand Lusch GmbH & Co. KG, Bielefeld, Fed. Rep. of Germany

[21] Appl. No.: 839,135

[22] Filed: Mar. 13, 1986

[30] Foreign Application Priority Data

Mar. 16, 1985 [DE] Fed. Rep. of Germany ... 8507806[U]

[51] Int. Cl.[4] ..... E04G 3/00

[52] U.S. Cl. ..... 248/297.3; 108/144; 248/295.1; 384/21

[58] Field of Search ..... 248/295.1, 284, 316.2, 248/297.3, 188.5, 125, 412; 297/345; 108/144; 384/21

[56] References Cited

U.S. PATENT DOCUMENTS

| | | | |
|---|---|---|---|
| 1,194,551 | 8/1916 | Schossler | 248/412 X |
| 2,381,340 | 8/1945 | Eastman | 248/412 X |
| 2,868,602 | 1/1959 | Drezner | 108/144 X |
| 3,604,369 | 9/1971 | Maslow | 108/144 |
| 4,130,069 | 12/1978 | Evans et al. | 108/144 X |
| 4,451,084 | 5/1984 | Seely | 248/297.3 X |
| 4,455,692 | 6/1984 | Hegge et al. | 248/297.3 X |
| 4,526,334 | 7/1985 | Rantakazi | 248/412 X |
| 4,565,263 | 1/1986 | Southworth | 248/188.5 X |

*Primary Examiner*—Ramon O. Ramirez

*Attorney, Agent, or Firm*—Erwin S. Teltscher

[57] ABSTRACT

An adjustment fitting for a height-adjustable mounting of a furniture part on a furniture main body includes a guiding sleeve and a carrier post partially received and slidably guided in the guiding sleeve. An arresting arrangement operative for arresting the carrier post in a multitude of positions relative to the guiding sleeve is concealed in at least one of the guiding sleeve and carrier post. The arresting arragement may include two cooperating parts one of which is secured to the guiding sleeve and the other to the carrier post, or it may be constituted by a clamping roller which is received in a downwardly tapering pocket of the guiding sleeve and is clamped between the inclined surface bounding such a pocket and the external surface of the carrier post. The furniture part may also be mounted on the carrier post for pivoting about an axis extending transversely to the longitudinal axis of the carrier post.

3 Claims, 10 Drawing Figures

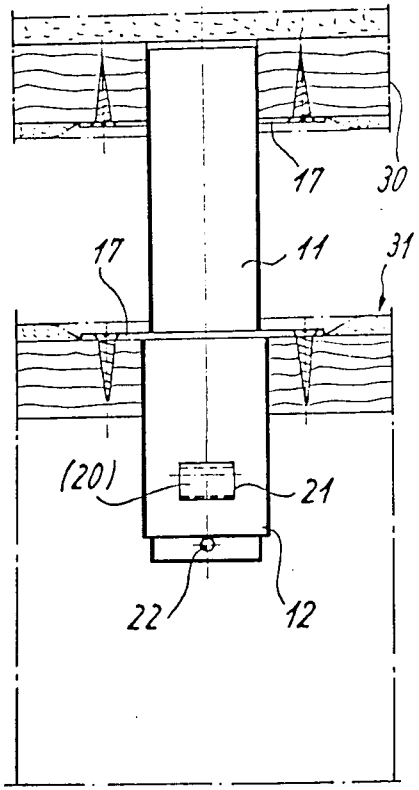
Fig. 7
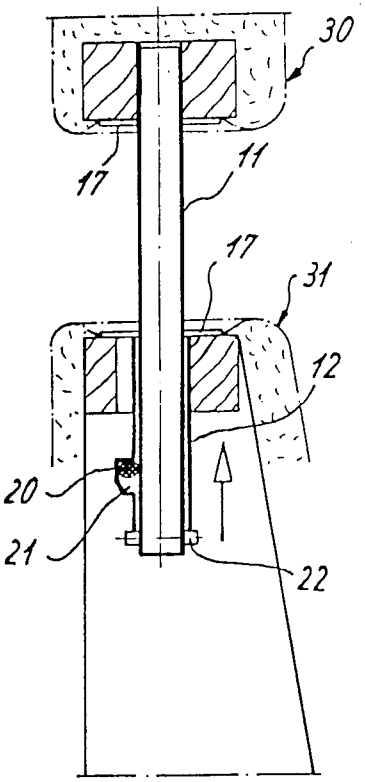
Fig. 6
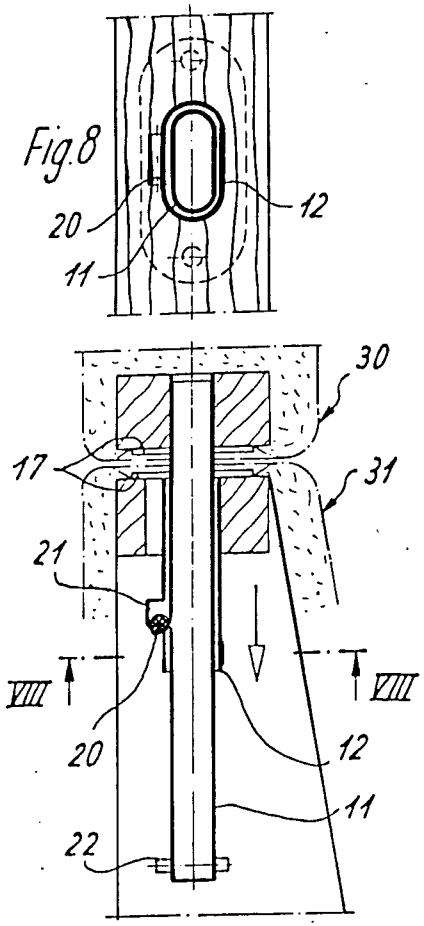
Fig. 8
Fig. 5

HEIGHT-ADJUSTABLE FITTING FOR FURNITURE

BACKGROUND OF THE INVENTION

The present invention relates to adjustable fittings in general, and more particularly to a height-adjustment fitting for an article of furniture including at least two separate parts.

There are already known various constructions of height-adjustment fittings of the above type, among them such which include a guiding sleeve connected to one of the separate furniture parts and a carrier post secured to the other furniture part and partially received in the guiding sleeve for sliding therein, as well as an arresting arrangement which arrests the carrier post in any one of a multitude of positions thereof relative to the guiding sleeve. However, experience with such known arrangements or fittings has shown that, despite their complexity, they are often if not always rather unsightly, especially since the arresting arrangements are visible at the exterior. This, of course, significantly detracts from the esthetic appeal of a furniture article employing such an adjustment fitting.

SUMMARY OF THE INVENTION

Accordingly, it is a general object of the present invention to avoid the disadvantages of the prior art.

More particularly, it is an object of the present invention to construct the adjustment fitting of the type here under consideration in such a manner as not to have a deleterious esthetic impact.

Still another object of the present invention is so to design the adjustment fitting of the above type as to be suited for use particularly in household furniture.

In keeping with these objects and others which will become apparent hereafter, one feature of the present invention resides in an adjustment fitting for a height-adjustable furniture part, comprising a guiding sleeve; a carrier post partially received in the guiding sleeve for shifting therein; and means for arresting the carrier post in a multitude of shifted positions relative to the guiding sleeve, the arresting means being arranged within one of the guiding sleeve and carrier post. A particular advantage of the arrangement of the present invention as described so far is that the arresting means is so concealed or obscured that it cannot be recognized by the user of the furniture article. As a consequence, the adjustment fitting of this type is particularly suited for use in household furniture articles, since a particular emphasis is put especially in this field on the esthetically pleasing appearance and arrangement of the adjustment fitting. Obviously, the concealed arrangement of the arresting means contributes to the esthetic appeal of the furniture article.

According to an advantageous construction of the present invention, therefore, the arresting means includes two cooperating parts one of which is secured to the carrier post and the other to the guiding sleeve, and these parts of the arresting means are so constructed as to provide for a stepwise adjustment of the height of, for instance, a head rest which is secured to the carrier post with respect to a furniture main body which has the guiding sleeve embedded or otherwise accommodated therein.

Herein, when the furniture part is in its raised position, only the carrier post is visible, and such carrier post may have, for optical or esthetic reasons, a high-quality outer surface. It is also advantageous, in accordance with another facet of the present invention, when the arresting means includes an outwardly projecting pocket in the guiding sleeve, the pocket having a downwardly tapering wedge-like configuration, and a clamping roller extending transversely of the longitudinal axis of the carrier post and received in the pocket. Then, the arresting action is achieved by a clamping engagement of the clamping roller between the inclined surface which partially bounds the pocket and the outer surface of the carrier post.

According to another advantageous aspect of the present invention, there is provided a closing plate mounted at one end of the carrier post for pivoting about an axis extending transversely of the longitudinal axis of the carrier post. Advantageously, the closing plate has such a cross-sectional configuration as to extend in all directions beyond the carrier post and includes two lugs which are bent out of the plane of the closing plate to extend parallel to the carrier post. There are further provided two profiled elements arranged between the lugs and the carrier post, and a connecting bolt which passes through the lugs, the profiled elements and the carrier post to connect the lugs and profiled elements to the carrier post under pre-tension and to serve as a pivoting axle. It is also advantageous when the profiled elements partially embrace the carrier post; and when the lugs and the profiled elements have mutually facing surfaces which are flat. The profiled elements provide for a desired degree of frictional retention of the furniture part in position, but this frictional retention effect can be overcome and the furniture part can be pivoted into any desired position within its pivoting range. Herein, the closing plate is advantageously arranged in a sunken position in the furniture part and covers respective edge portions of the upholstery so as to obtain a clean termination at this region as well. Depending on the size of the furniture article, a necessary number of the adjustment fittings can be provided without running into any problems.

Advantageously, the cross-sectional configurations of the carrier post and of the guiding sleeve are non-circular, especially oval. The clamping roller is of a synthetic plastic material, especially of a polyamide.

BRIEF DESCRIPTION OF THE DRAWING

Several embodiments of the present invention will be described below in detail with reference to the accompanying drawing in which:

FIG. 5 is a view corresponding to that of FIG. 1 but showing a different embodiment of the adjustment fitting;

FIG. 6 is a view corresponding to that of FIG. 2 but of the embodiment of FIG. 5;

FIG. 7 a view corresponding to that of FIG. 3 but of the embodiment of FIG. 5;

FIG. 8 is a detailed sectional view taken on line VIII—VIII of FIG. 4;

DETAILED DESCRIPTION OF THE PREFERRED EMBODIMENTS

Figure 3:
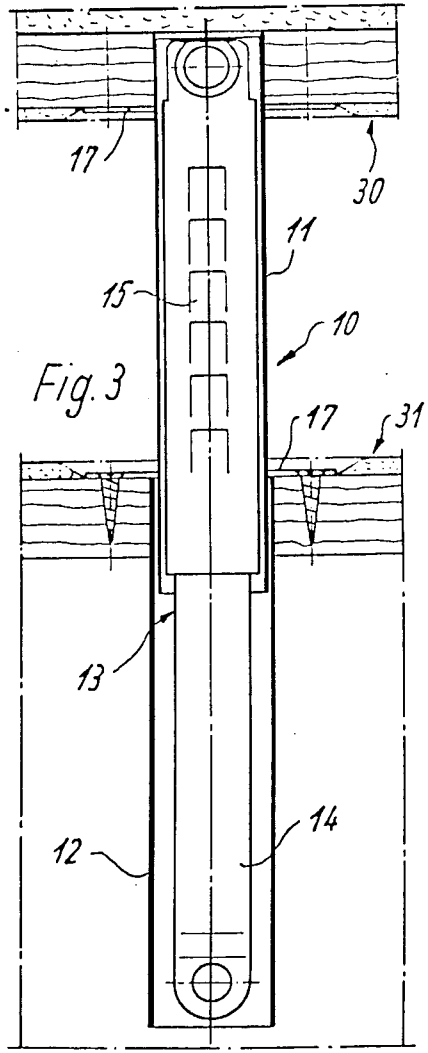
FIG. 3 is a partially sectioned view akin to that of FIG. 1 but in a front elevation.
Figure 2:
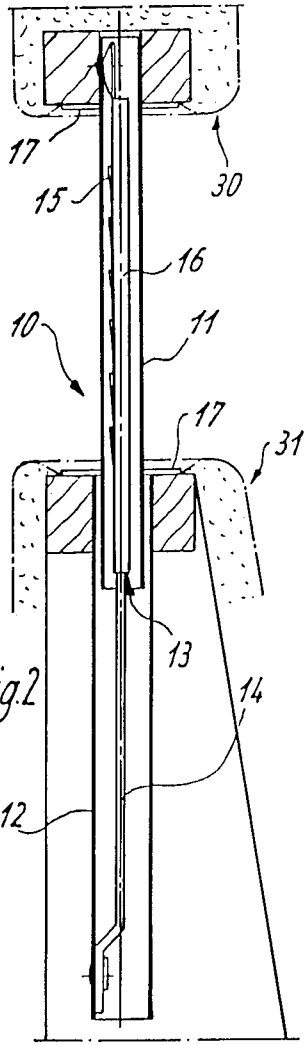
FIG. 2 is a view similar to FIG. 1 but showing the furniture part in its extended end position.

Referring now to the drawing in detail, and first to FIGS. 1 to 4 thereof, it may be seen that the reference numeral 10 has been used therein to identify an adjustment fitting. The adjustment fitting 10 includes a guiding sleeve 12 which is secured in position in a furniture main body 31 and has a free end which opens to the exterior of the furniture main body 31 somewhat offset with respect to the external surface of the furniture main body 31. A carrier post 11 is received in the interior of the guiding sleeve 12 for sliding relative to the guiding sleeve 12. The carrier post 11 has one end portion which is secured in position in the interior of a furniture part 30 and another end portion which extends to a greater or lesser extent into the interior of the guiding sleeve 12, depending on the extent of height adjustment.

A stop arrangement 13, which is of a known construction, includes a stop tongue 14 having an offset end portion which is connected to the guiding sleeve 12. On the other hand, a stop sleeve 16 which is movable with respect to the stop tongue 14 and which is provided with stop pockets 15 is secured in position on the carrier post 11.

The region of entry of the carrier post 11 into the furniture part 30, as well as the region of emergence of the guiding sleeve 12 out of the furniture main body 31 are each covered by a respective closing plate 17.

Figure 4:
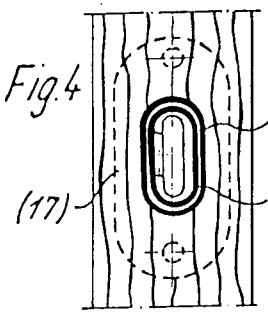
FIG. 4 is a detailed sectional view taken on line IV—IV of FIG. 1.
Figure 1:
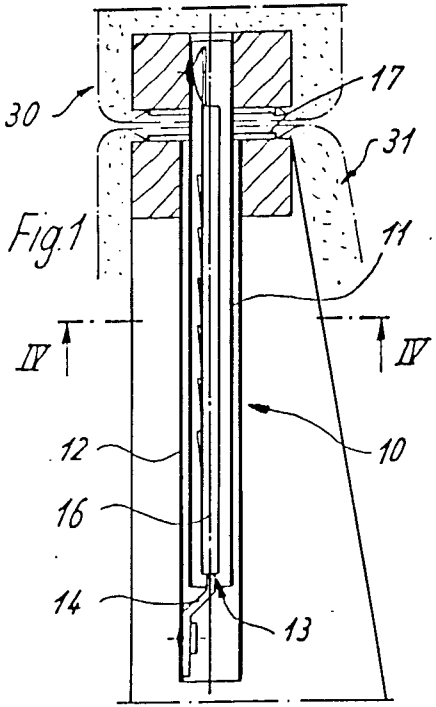
FIG. 1 is a partially sectioned side elevational view of a diagrammatically indicated furniture article and an adjustment fitting of the present invention incorporated therein.

It may clearly be seen in FIG. 4 of the drawing that both the guiding sleeve 12 and the carrier post 11 have oval cross-sectional configurations. Such oval configurations not only bring about optical and esthetic advantages, but also provide for the needed stability. Of course, other cross-sectional configurations are also possible and are contemplated by the present invention.

The basic concept of the present invention, that is, the concealment of the arresting means, can be ascertained from the above-discussed example of a construction in accordance with the present invention just as well as from another modified exemplary structure of the present invention which is revealed in and will now be discussed in conjunction with FIGS. 5 to 8 of the drawing.

Even in this particular structure, the arrangement and configuration of the arresting means cannot be perceived from the exterior, in that this structure includes a clamping roller 20 which extends transversely with respect to the longitudinal axis of the carrier post 11 and is received in a pocket 21 of the guiding sleeve 12. Herein, the pocket 21 is situated at the lower region of the guiding sleeve 12 which extends into the furniture main body 31, and is so shaped as to protrude outwardly of the guiding sleeve 12. Furthermore, the pocket 21 is so configurated that its cross section narrows in the downward direction in a wedge-like manner, so that the clamping roller 20 is clamped, during the movement of the furniture part 30 in a direction toward the furniture main body 31, between the inclined surface which partially bounds the pocket 21, on the one hand, and the carrier post 11, on the other hand. In this manner, an independent descent of the furniture part 30 under the influence of its own weight is prevented. Yet, the wedging effect of the clamping roller 20 can be overcome by exerting a certain predetermined force to the furniture part 30 and the furniture part 30 can thus be brought into its initial or rest position without encountering any problems.

Inasmuch as the dimensions of the upper part of the pocket 21 at least correspond to the corresponding dimensions of the clamping roller 20, and especially to the diameter of such clamping roller 20, the clamping roller 20 is released during the upward movement of the furniture part 30, so that a desirable operating convenience and comfort is obtained here.

Each stop pocket 21 is formed along its longitudinal direction with a gently sloping depression merging with an abrupt depression. Hence, in the depressed position of the actuating tongue, the slider can only move in one direction, i.e. along the gently sloping depression, but is prevented in a ratchet-like manner from moving in the other direction.

According to another advantageous feature of the present invention, the clamping roller 20 is of a synthetic plastic material, preferably of a polyamide. However, it should be understood that other materials are also possible and contemplated for the clamping roller 20.

In order to prevent the possibility that the furniture part 30 could be separated from the furniture main body 31 as a result of a total extraction of the carrier post 11 from the guiding sleeve 12 as the furniture part 30 is displaced upwardly, it is provided that a limiting pin 22 which extends transversely of the longitudinal axis of the carrier post 11 is arranged at the lower end region of the carrier post 11. The length of the limiting pin 22 is the same as or exceeds the corresponding dimension of the guiding sleeve 12. Therefore, during the positional adjustment of the furniture part 30, the upper end position of the furniture part 30 is limited by the limiting pin 22.

In the same manner as discussed before in connection with FIG. 4, the cross-sectional configurations of both the guiding sleeve 12 and the carrier post 11 are oval in this particular structure as well, as particularly shown in FIG. 8 of the drawing.

A further advantage of this particular construction is that, as a result of the free movement in the upward direction, on the one hand, and the clamping effect of the clamping roller 20 during movement in the downward direction, on the other hand, there is obtained an adjustment of the position of the furniture part 30 which is, for all intents and purposes, stepless.

Figure 11:
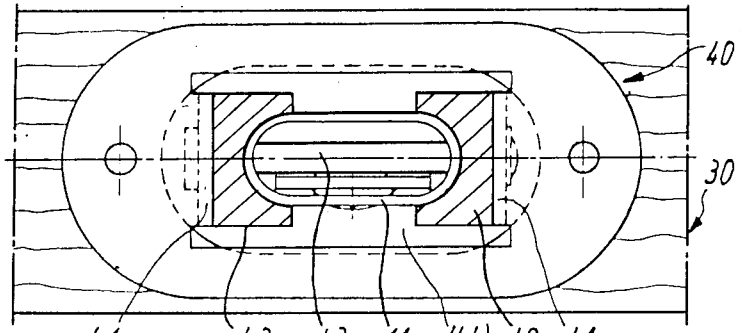
FIG. 11 is a sectional view of a detail taken on line XI—XI of FIG. 10.
Figure 10:
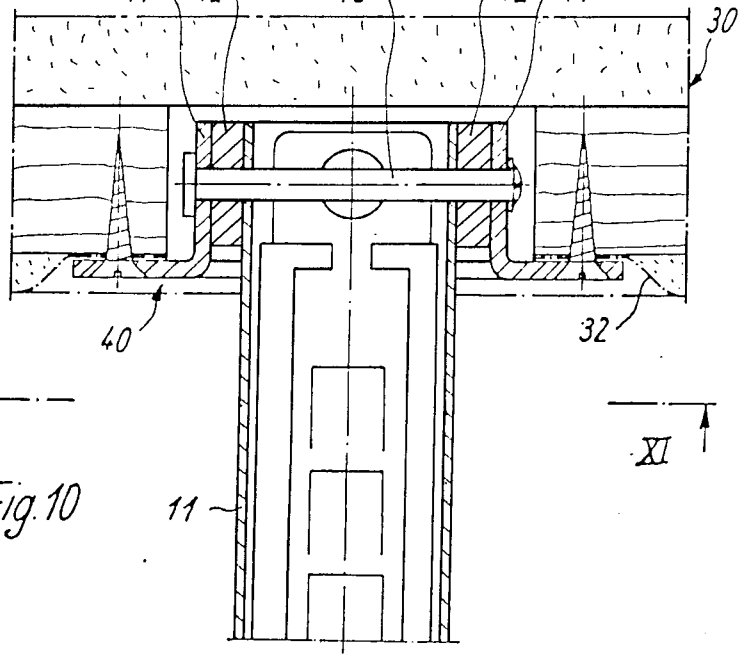
FIG 10 is a partial sectional view akin to that of FIG. 9 but in front elevation.
Figure 9:
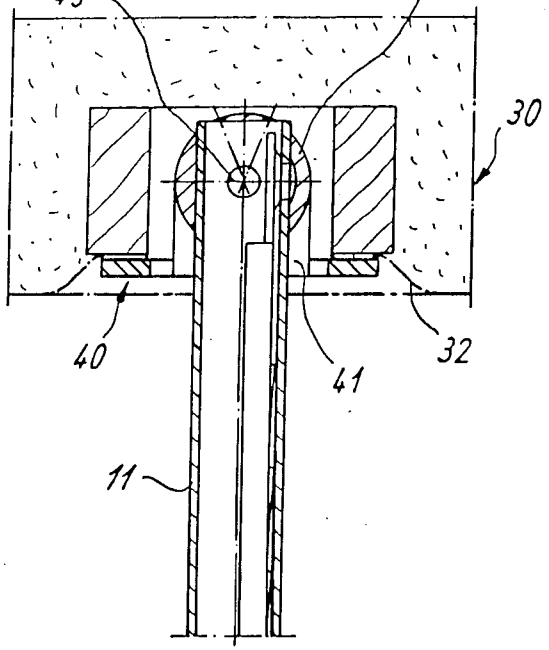
FIG. 9 is a partial sectional side elevational view of a region of connection of the furniture part to the carrier post.

FIGS. 9 to 11 show a further advantageous construction in accordance with the present invention, wherein the furniture part 30 is pivotable about a horizontal axis. In this construction, a closing plate 40 is so configured that its cross section extends beyond the carrier post 11 in all directions. The closing plate 40 is connected to the furniture part 30 at the entry region of the carrier post 11 and is recessed into the furniture part 30 with respect to the outer surface of the furniture part 30. The closing plate 40 also covers, at the appropriate region, an edge portion of an upholstery material 32 that encases the furniture part 30.

The closing plate 40 further includes a central rectangular cutout 44 which is stamped out of the closing plate 40. A lug 41 is formed at each of the shorter sides of the cutout 40 and extends into the interior of the furniture part 30.

A cylindrical profiled element 42 is arranged between each lug 41 and the correspondingly associated smaller side of the oval carrier post 11. The profiled element 42 has a contour at its side facing the carrier post 11 which corresponds to the cross-sectional configuration of the carrier post 11, so that the carrier post 11 is partially embraced by each profiled element 42.

A pivoting axle 43, which is constituted by a connecting bolt, extends transversely with respect to the longitudinal axis of the carrier post 11 and passes through the lugs 41, the profiled elements 42 and the carrier post 11, thus connecting these components to one another in that it engages the respective outer surfaces of the lug 41 by means of respective heads which are either formed thereon or threadedly connected thereto.

According to another advantageous concept of the present invention, it is proposed that the pivotable mounting feature for the furniture part 30 as depicted in FIGS. 9 to 11 of the drawing can also be combined with the height adjustability of the furniture part 30 corresponding to the construction which is shown in FIGS. 1 to 4 of the drawing, or with the structure which is revealed in FIGS. 5 to 8 of the drawing.

What is claimed is:

1. An adjustment fitting for a height-adjustable furniture furniture, comprising in combination a guiding sleeve;

an elongated carrier post partially received in said guiding sleeve for shifting therein and defining a longitudinal axis;

a furniture part connected to one of said guiding sleeve and said elongated carrier, said guiding sleeve and said carrier post having non-circular cross-sectional configurations;

means for arresting said carrier post in a multitude of shifted positions relative to said guiding sleeve, said arresting means being free of any lever means or pawl means and arranged within one of said guiding sleeve said and carrier post, said arresting means including an outwardly projecting pocket in said guiding sleeve, said pocket having a downwardly tapering wedge-like configuration, and a clamping roller made of synthetic material and extending transversely to the longitudinal axis of said carrier post, received in said pocket, and normally exerting a wedging effect, whereby an independent descent of the furniture part under its own weight is prevented by said wedging effect, but said wedging effect may be overcome by exerting a certain predetermined force onto said furniture part, so that said furniture part may be brought into a rest position.

2. The adjustment fitting as defined in claim 1, wherein said cross-sectional configurations are oval.

3. The adjustment fitting as defined in claim 1, wherein said synthetic plastic material is a polyamide.

* * * * *